US008920523B2

(12) United States Patent
Kawamoto et al.

(10) Patent No.: US 8,920,523 B2
(45) Date of Patent: Dec. 30, 2014

(54) FUEL OIL FLOW IMPROVER AND FUEL OIL COMPOSITION

(75) Inventors: Hideki Kawamoto, Hyogo (JP); Fumitaka Yoshikawa, Hyogo (JP); Akira Morita, Hyogo (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 14/006,061

(22) PCT Filed: Mar. 28, 2012

(86) PCT No.: PCT/JP2012/058085

§ 371 (c)(1),
(2), (4) Date: Sep. 18, 2013

(87) PCT Pub. No.: WO2012/133502

PCT Pub. Date: Oct. 4, 2012

(65) Prior Publication Data

US 2014/0007496 A1 Jan. 9, 2014

(30) Foreign Application Priority Data

Mar. 29, 2011 (JP) ..... 2011-072119

(51) Int. Cl.

| | |
|---|---|
| ***C10L 1/18*** | (2006.01) |
| ***C10L 1/232*** | (2006.01) |
| ***C10L 10/14*** | (2006.01) |
| ***C10L 1/14*** | (2006.01) |
| ***C10L 1/196*** | (2006.01) |
| ***C10L 1/222*** | (2006.01) |
| ***C10L 1/224*** | (2006.01) |
| *C10L 1/16* | (2006.01) |
| *C10L 1/2383* | (2006.01) |

(52) U.S. Cl.

CPC ..... *C10L 1/232* (2013.01); *C10L 10/14* (2013.01); *C10L 1/143* (2013.01); *C10L 1/1966* (2013.01); *C10L 1/2225* (2013.01); *C10L 1/224* (2013.01); *C10L 1/222* (2013.01); *C10L 2230/14* (2013.01); *C10L 2270/026* (2013.01); *C10L 1/1641* (2013.01); *C10L 1/1963* (2013.01); *C10L 1/2383* (2013.01)

USPC ..... 44/331; 44/391

(58) Field of Classification Search

USPC ..... 44/331, 391

See application file for complete search history.

(56) References Cited

U.S. PATENT DOCUMENTS

| | | | | | |
|---|---|---|---|---|---|
| 3,063,819 | A | * | 11/1962 | Moseley et al. | 44/391 |
| 4,882,034 | A | * | 11/1989 | Tack et al. | 208/15 |
| 5,178,641 | A | * | 1/1993 | Konrad et al. | 44/392 |
| 5,964,907 | A | * | 10/1999 | Farmer et al. | 44/391 |

FOREIGN PATENT DOCUMENTS

| | | | |
|---|---|---|---|
| JP | 2-138389 | A | 5/1990 |
| JP | 11-80757 | A | 3/1999 |
| JP | 2002-167585 | A | 6/2002 |
| JP | 2002-167586 | A | 6/2002 |

(Continued)

*Primary Examiner* — Cephia D Toomer

(74) *Attorney, Agent, or Firm* — Muncy, Geissler, Olds & Lowe, P.C.

(57) ABSTRACT

A fuel oil flow improver comprising the ester compound (A) below and the copolymer (B) below, which is the fuel oil flow improver in which the mass ratio [(A)/(B)] of the ester compound (A) and the copolymer (B) is from 30/70 to 70/30.

(A) The ester compound represented by Formula (I) below.

(I)

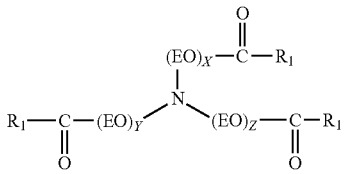

$R_1$ is e.g. a linear saturated C19 alkyl group, and X, Y, and Z each represent an integer of 1 or higher.

(B) A copolymer of a weight-average molecular weight of 5,000 to 50,000 obtained by polymerizing (b1) to (b3) below at a molar fraction of (b1)/(b2)/(b3)=0.4 to 0.8/0.1 to 0.3/0.1 to 0.3.

(b1)

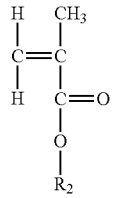

$R_2$ is e.g. a linear saturated C14 alkyl group.

(b2)

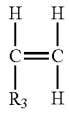

$R_3$ is e.g. a linear saturated C10 alkyl group.

(b3)

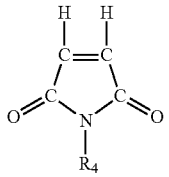

$R_4$ is e.g. a linear saturated C12 alkyl group.

2 Claims, No Drawings

(56) References Cited

FOREIGN PATENT DOCUMENTS

| | | | |
|---|---|---|---|
| JP | 2002-516364 | A | 6/2002 |
| JP | 2003-165984 | A | 6/2003 |
| JP | 2006-306989 | A | 11/2006 |
| JP | 2007-186700 | A | 7/2007 |
| JP | 2008-63374 | A | 3/2008 |
| JP | 2009-541507 | A | 11/2009 |
| WO | WO 2011/099406 | A1 | 8/2011 |

* cited by examiner

FUEL OIL FLOW IMPROVER AND FUEL OIL COMPOSITION

BACKGROUND OF THE INVENTION

1. Field of the Invention

The present invention relates to a fuel oil flow improver and a fuel oil composition. More specifically, the present invention relates to a fuel oil flow improver which can sufficiently reduce the plugging point or the pour point of fuel oil, which has excellent dispersibility of a wax precipitated from the fuel oil to which the fuel oil flow improver is added, and also relates to a fuel oil composition containing the fuel oil flow improver.

2. Description of the Related Art

Fuel oils such as light diesel oil and heavy oil A contain a wax which is a long chain n-paraffin, and when the oil temperature decreases, such as in winter, problems occur such as the wax precipitating and plugging the filters in the fuel oil line, or congealing such that fluidity is lost, blocking the line. The temperature at which filter described above is plugged is referred to as the cold filter plugging point (CFPP), and the temperature at which fluidity is lost is referred to as the pour point (PP). Normally, a flow improver is used during the winter in order to improve the plugging point and the pour point.

In addition, in fuel oils such as light diesel oil or heavy oil A, a problem also arises in which the wax precipitates within the fuel tank, and the precipitated wax settles on the base of the tank to form a thick, dense wax layer. It is known that when such a problem occurs, the ability of the engine to start is degraded remarkably, and a wax dispersibility modifier is used in order to improve the problem described above.

As a fuel oil flow improver to impart an improvement to the plugging point, an improvement to the pour point described above, and further, to impart excellent wax dispersibility, for example, it is disclosed in Patent Literature 1 that using a reaction product of an amide compound, including active hydrogen within the molecules, and an alkylene oxide, together with another polymeric additive improves the plugging point and the pour point, and increases the wax dispersibility. In addition, it is disclosed in Patent Literature 2 that a condensation reaction product between an aldehyde, a salicylate, and an alkylphenol, or a compound prepared as a salt by reacting the condensation reaction product with an alkylamine is used in order to improve a degradation of the plugging point caused by using a wax dispersibility modifier, an ethylene-vinyl acetate copolymer, and the like together with each other, thereby the degradation in the plugging point is resolved and an excellent wax dispersibility is exhibited. Furthermore, in Patent Literature 3, it is disclosed that a fuel oil additive containing a graft polymer in which an alkyl acrylate is grafted to an ethylene-vinylester copolymer with a vinyl acetate content of less than 3.5 mol % exhibits an improvement in the plugging point as well as the wax dispersibility.

Meanwhile, automobile exhaust gas regulations are becoming stricter globally in order to improve the environmental problems in recent years. Various exhaust gas purification measures are being promoted in relation to such exhaust gas regulations, and attempts are being made to further reduce harmful components present in the exhaust gas such as nitrogen oxide (NOx) and particulate matter (PM).

As one such technological development, a diesel engine with a high pressure fuel injection pump referred to as a "common rail system" is being developed. This is a system in which fuel of extremely high pressure is injected using accurate computer control. In the common rail system, when trace amounts of foreign elements are present within the fuel, there are concerns that errors may occur in the computer control, therefore a fine fuel filter is provided in the fuel supply line. In a case of a vehicle in which a fine fuel filter is provided in the fuel supply line, the performance requirements in relation to fuel at a low temperature become even more demanding than they have been in the past, there are cases in which the improvement effect of the plugging point and the wax dispersibility is insufficient in a fuel oil flow improver of the related art, and there is a demand for a fuel oil flow improver having a higher improvement effect.

CITATION LIST

Patent Literature

[Patent Literature 1] Japanese Unexamined Patent Application Publication No. H11-80757

[Patent Literature 2] Japanese Unexamined Patent Application Publication No. 2002-516364

[Patent Literature 3] Japanese Unexamined Patent Application Publication No. 2007-186700

SUMMARY OF THE INVENTION

Technical Problem

An object of the present invention is to solve the above described problems, and more specifically, to provide a fuel oil flow improver and a fuel oil composition containing the fuel oil flow improver, with which it is possible to sufficiently improve the plugging point, the pour point, and the wax dispersibility; even if used in a vehicle with a fine fuel filter provided in the fuel supply line.

Solution to Problem

As a result of careful examination in order to solve the above problems, the present inventors discovered that a fuel oil flow improver comprised by mixing a specific ester compound (A) and a specific copolymer (B) at a specific mass ratio is capable of imparting to the fuel oil, an excellent plugging point improvement effect, an excellent pour point improvement effect, and excellent dispersibility of precipitated wax.

That is, the present invention provides:

a fuel oil flow improver comprising the ester compound (A) below and the copolymer (B) below, which is the fuel oil flow improver in which the mass ratio [(A)/(B)] of the ester compound (A) and the copolymer (B) is from 30/70 to 70/30.

(A) The ester compound represented by Formula (I) below.

[Chem. 1]

(I)

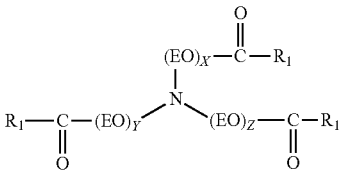

[$R_1$ is a linear saturated alkyl group containing 17 to 23 carbon atoms, (EO) represents an oxyethylene group, and X, Y, and Z each represent an integer of 1 or higher. In addition, the average number of additional moles (n) of the oxyethylene group is n=(X+Y+Z)/3, and satisfies 1≤n≤3.]

(B) A copolymer of a weight-average molecular weight of 5,000 to 50,000 obtained by polymerizing (b1) to (b3) below at a molar fraction of (b1)/(b2)/(b3)=0.4 to 0.8/0.1 to 0.3/0.1 to 0.3, which is the copolymer in which, when the copolymer is measured using a differential scanning calorimeter and cooled from 100° C. to −80° C. at 10° C./minute, the exothermic peak temperature (Tp) is −40° C.≤Tp≤−15° C.

[Chem. 2]

(b1)

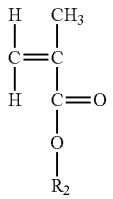

[$R_2$ represents a linear saturated alkyl group containing 10 to 18 carbon atoms.]

[Chem. 3]

(b2)

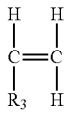

[$R_3$ represents a linear saturated alkyl group containing 8 to 16 carbon atoms.]

[Chem. 4]

(b3)

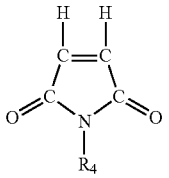

[$R_4$ represents a linear saturated alkyl group containing 10 to 16 carbon atoms.]

The present invention may also be a fuel oil composition containing the fuel oil flow improver and fuel oil, which contains 0.0005 to 1 parts by mass of the fuel oil flow improver in relation to 100 parts by mass of the fuel oil.

Advantageous Effects of Invention

Since the fuel oil flow improver of the present invention can sufficiently reduce the plugging point and the pour point of the fuel oil, and can also impart excellent wax dispersibility even if used in a vehicle with a high pressure fuel injection pump of a common rail system or the like and with a fine fuel filter provided in the fuel supply line, it can be favorably used without easily causing problems.

DETAILED DESCRIPTION OF THE PREFERRED EMBODIMENTS

Hereinafter, the present invention is described in more detail. The fuel oil flow improver (hereinafter also referred to as a flow improver) of the present invention comprises an ester compound (A) and a copolymer (B). First, the ester compound (A) will be described.

The ester compound (A) contained in the flow improver of the present invention is the ester compound represented by Formula (I) below.

[Chem. 5]

(I)

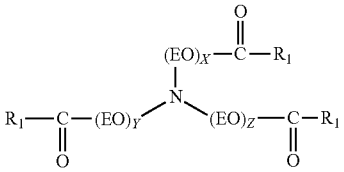

Here, $R_1$ is a linear saturated alkyl group containing 17 to 23 carbon atoms, (EO) represents an oxyethylene group, and X, Y, and Z each represent an integer of 1 or higher. In addition, the average number of additional moles (n) of the oxyethylene group is calculated using n=(X+Y+Z)/3, and satisfies 1≤n≤3. Furthermore, the three linear saturated alkyl groups in Formula (I) may each contain the same or a different number of carbon atoms.

The ester compound (A) may be prepared using an ordinary manufacturing method. For example, the ester compound (A) can be obtained by adding an ethylene oxide to a nitrogen-containing compound including three active hydrogen atoms such as ammonia and triethanolamine, and subsequently esterifying a linear saturated fatty acid containing 18 to 24 carbon atoms. In addition, as another method, the ester compound (A) can be obtained by using a method in which a triethanolamine and a linear saturated fatty acid containing 18 to 24 carbon atoms are esterified, and subsequently, an ethylene oxide is added to the molecule.

However, in the present invention, of the three locations at which the oxyethylene group bounds with the nitrogen atom, the average number of additional moles (n) of the oxyethylene group per location is 1≤n≤3. When n is less than 1, the solubility of the (A) component in relation to the fuel oil is insufficient, and there are cases in which a sufficient improvement effect of the plugging point may not be obtained. In addition, when n is more than 3, conversely, the solubility of the (A) component in relation to the fuel oil rises too much, and there are cases in which a sufficient improvement effect of the plugging point and an improvement effect of the pour point may not be obtained.

Examples of the linear saturated fatty acid which provides a linear saturated fatty acid residue containing 18 to 24 carbon atoms containing $R_1$ in the Formula (I) include stearic acid, arachidic acid, behenic acid, and tetradecene acid. In the present invention, from the perspective of the improvement effect on the plugging point, it is preferable to use arachidic acid, behenic acid, or a mixture of these. In addition, one type of the ester compound (A) described above can be used alone, or two or more types thereof can be used in combination.

The copolymer (B) contained in the flow improver of the present invention is a copolymer obtained by polymerizing the monomers (b1), (b2), and (b3) below.

[Chem. 6]

(b1)

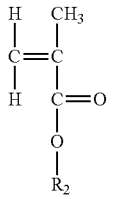

[$R_2$ represents a linear saturated alkyl group containing 10 to 18 carbon atoms.]

[Chem. 7]

(b2)

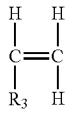

[$R_3$ represents a linear saturated alkyl group containing 8 to 16 carbon atoms.]

[Chem. 8]

(b3)

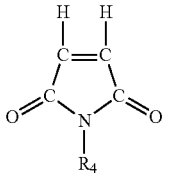

[$R_4$ represents a linear saturated alkyl group containing 10 to 16 carbon atoms.]

Here, it is shown respectively that $R_2$ of the monomer (b1) is a linear saturated alkyl group containing 10 to 18 carbon atoms, $R_3$ of the monomer (b2) is a linear saturated alkyl group containing 8 to 16 carbon atoms, and $R_4$ of the monomer (b3) is a linear saturated alkyl group containing 10 to 18 carbon atoms.

When the number of carbon atoms contained in $R_2$ is less than 10, there are cases in which the improvement effect of the pour point is insufficient when the flow improver is added to the fuel oil. In addition, when the number of carbon atoms is more than 18, there are cases in which the improvement effect of the plugging point and the improvement effect of the pour point are insufficient. A preferable $R_2$ is a linear saturated alkyl group containing 12 to 16 carbon atoms. A more preferable $R_2$ is a linear saturated alkyl group containing 14 to 16 carbon atoms. In addition, two or more types of the monomer (b1) in the present invention may also be mixed and used together. When two or more types are mixed and used together, the average number of carbon atoms of $R_2$ is preferably 12 to 16, and the average number of carbon atoms of $R_2$ is more preferably 14 to 16.

When the number of carbon atoms contained in $R_3$ is less than 8, there are cases in which the improvement effect of the pour point is insufficient when the flow improver is added to the fuel oil. In addition, when the number of carbon atoms of $R_3$ is more than 16, there are cases in which the improvement effect of the pour point and the dispersibility of the precipitated wax are insufficient.

When the number of carbon atoms contained in $R_4$ is less than 10, there are cases in which the improvement effect of the plugging point and the improvement effect of the pour point are insufficient when the flow improver is added to the fuel oil. In addition, when the number of carbon atoms of $R_4$ is more than 16, similarly, there are also cases in which the improvement effect of the plugging point and the improvement effect of the pour point are insufficient.

When the monomers (b1), (b2), and (b3) described above are polymerized to manufacture the copolymer (B) in the present invention, the molar fraction of (b1), (b2), and (b3) is (b1)/(b2)/(b3)=0.4 to 0.8/0.1 to 0.3/0.1 to 0.3. When the molar fraction of (b1) is less than 0.4, there are cases in which the improvement effect of the plugging point is insufficient, and when it is more than 0.8, there are cases in which the improvement effect of the plugging point and the dispersibility of the precipitated wax are insufficient. In addition, when the molar fraction of (b2) is less than 0.1, there are cases in which the improvement effect of the plugging point and the dispersibility of the precipitated wax are insufficient, and when it is more than 0.3, there are cases in which the improvement effect of the plugging point is insufficient. In addition, when the molar fraction of (b3) is less than 0.1, there are cases in which the improvement effect of the plugging point and the dispersibility of the precipitated wax are insufficient. In the present invention, a preferable molar fraction of (b1), (b2), and (b3) is (b1)/(b2)/(b3)=0.5 to 0.7/0.15 to 0.25/0.15 to 0.25.

Since the copolymer (B) can be prepared using a normal polymerization method, is easy to polymerize, and the usability of the polymer is excellent, solution polymerization using a radical initiator is preferable. As the radical initiator, azo-based and peroxide-based radical initiators are used, and as the solvent, it is preferable to use solvents such as hydrocarbon systems and aromatic systems with excellent monomer and polymer solubility. In addition, it is possible to obtain the copolymer (B) using one of the following methods. A method in which the monomers (b1), (b2), and (b3) are respectively prepared and polymerized. Alternatively, a method in which the monomers (b1), (b2), and a maleic anhydride are polymerized in advance, a primary amine containing $R_4$ is subsequently added at a ratio of 0.7 to 1.3 moles per mole of maleic anhydride, and imidization reaction is performed at 70 to 170° C.

The weight-average molecular weight of the copolymer (B) of the present invention is 5,000 to 50,000. When the weight-average molecular weight is less than 5,000, there are cases in which the improvement effect of the plugging point is insufficient. In addition, when it is more than 50,000, there are cases in which the improvement effect of the pour point is insufficient. The weight-average molecular weight is preferably 7,500 to 45,000, and more preferably 10,000 to 30,000.

In the copolymer (B) of the present invention obtained using the method described above, the exothermic peak temperature (Tp) measured using a differential scanning calorimeter is within a range of −40° C. to −15° C. In other words, −40° C.≤Tp≤−15° C.

The method of measuring the exothermic peak temperature (Tp) in the present invention is as follows. 10 mg of the copolymer (B) is weighed in the differential scanning calorimeter, is heated, under a nitrogen atmosphere, from room temperature to 100° C., and is subsequently maintained at 100° C. for 10 minutes. Subsequently, the copolymer (B) is cooled from 100° C. to −80° C. at 10° C./minute, and the exothermic peak temperature is obtained at this time. The exothermic peak temperature (Tp) adopts the value at which the DDSC (the derivative of the DSC curve) reaches 0. In addition, when there are a plurality of peaks, the value of the highest exothermic peak temperature is adopted.

When the exothermic peak temperature (Tp) is lower than −40° C., there are eases in which the improvement effect of the plugging point and the improvement effect of the pour point are insufficient. In addition, when the exothermic peak temperature (Tp) is higher than −15° C., there are cases in which the improvement effect of the plugging point and the improvement effect of the pour point are insufficient. A preferable exothermic peak temperature (Tp) is $-20 \leq To \leq -35°$ C.

Even if the ester compound (A) is used alone in the flow improver of the present invention, the improvement effect of the plugging point, the improvement effect of the pour point, and the improvement effect of the dispersibility of wax which are obtained are insufficient. In addition, even if the copolymer (B) is used alone, the improvement effect of the plugging point, and the wax dispersibility which are obtained are insufficient. The flow improver of the present invention is capable of imparting to the fuel oil, the excellent improvement effect of the plugging point, the excellent improvement effect of the pour point, and the excellent wax dispersibility, by containing the ester compound (A) and the copolymer (B) at a mass ratio of 30/70 to 70/30. When the mass ratio of the ester compound (A) is less than 30 and the copolymer (B) is more than 70, there are cases in which the improvement effect of the plugging point is insufficient. In addition, when the mass ratio of the ester compound (A) is more than 70 and the copolymer (B) is less than 30, there are cases in which the improvement effect of the pour point is insufficient. The mass ratio of (A) and (B) in the present invention is preferably 35/65 to 65/35, and is more preferably 40/60 to 60/40.

The flow improver of the present invention may be used as it is in the fuel oil as an additive, however, normally, in order to simplify the usability, it may also be diluted with, for example, an organic solvent (an additive solution dilution product) and used.

Examples of such a solvent include petroleum distillates such as kerosene, light diesel oil, and hydrocracked oil, aromatic hydrocarbon, paraffinic hydrocarbon, and naphthenic hydrocarbon, an aromatic hydrocarbons solvent is used preferably, and a solvent with a boiling point of 100 to 250° C. is particularly preferable.

The fuel oil composition of the present invention contains the flow improver of the present invention and the fuel oil. In relation to 100 parts by mass of the fuel oil, the fuel oil composition contains 0.0005 to 1 parts by mass of the flow improver of the present invention, and furthermore, preferably contains from 0.005 to 0.1 parts by mass. When the content of the flow improver is less than 0.0005 parts by mass, there are cases in which the improvement effect of the plugging point, the improvement effect of the pour point, and the dispersibility of the precipitated wax may not be sufficiently obtained, and conversely, when the content is more than 1 parts by mass, there are also cases in which an effect corresponding to the amount added may not be obtained.

As the fuel oil which may be used in the fuel oil composition of the present invention, fuel oil comprised of a petroleum distillate with a boiling point in a range of 130 to 450° C. is preferable, and diesel fuel oil comprised of a distillate of 140 to 380° C. is particularly preferable. In addition, the fuel oil comprised of the petroleum distillate exhibits a particularly remarkable effect by adding the flow improver of the present invention to a low sulfur diesel oil, which has a low sulfur content and is refined using extreme hydrogenation. Low sulfur diesel oil with a sulfur content of 0.05 mass % or less is preferable, and low sulfur diesel oil with a sulfur content of 0.005 mass % or less is more preferable.

Such a low sulfur diesel oil can normally be prepared by appropriately mixing straight diesel oil, directly hydrodesulfurized diesel oil, indirectly hydrodesulfurized diesel oil, hydrocracked diesel oil, hydrodesulfurized heavy gas oil, desulfurized kerosene, and the like.

Further, as the fuel oil, in addition to fuels oil obtained using petroleum refining, synthetic fuel oils obtained from a synthetic gas through a Fischer-Tropsch reaction, animal and vegetable oils and fats, or bio diesel oils obtained by the transesterification of animal and vegetable oils and fats, hydrogenated oil and fat fuels obtained by hydrogenating animal and vegetable oils and fats, distillate diesel oil obtained from algae, or a blend of these may be used.

When adding the flow improver of the present invention to the fuel oil, including cases in which the flow improver is simply to be added to the fuel oil, various methods of addition may be adopted. Normally, a method in which the flow improver is added using a solution where the flow improver is diluted by kerosene, light diesel oil, solvent, or the like in advance, a method in which the flow improver is heated to approximately 40 to 60° C. and added, or a method in which both of these methods are used together to add the flow improver may be used.

The fuel oil composition of the present invention, according to demand, may be made to appropriately contain various additives and the like which are commonly used in the related art as fuel oil additives, in addition to the flow improver of the present invention. For example, the fuel oil composition of the present invention may be made to appropriately contain various additives and the like such as a lubricity improver, a detergent dispersant, an antioxidant, a cetane improver, an exhaust smoke reduction agent, and a conductivity improver.

Examples

Next, the present invention will be described in further detail using examples.

The flow improver was prepared by combining the ester compound of Formula (I), which is represented by an ester 1 and an ester 2 shown in Table 1, with a copolymer of polymers 1 to 14, in which the monomers (b1), (b2), and (b3) containing the linear saturated alkyl group shown in Table 2 were polymerized at the molar fraction denoted in Table 2. In relation to the obtained flow improver, evaluation of the plugging point, the pour point, and the dispersibility of the precipitated wax was performed using the fuel oil shown in Table 3.

The evaluation results of adding 0.02 mass % of the flow improver to fuel oil I shown in Table 3 are shown in Table 4. In addition, the evaluation results of adding 0.01 weight % of the flow improver to fuel oil II shown in Table 3 are shown in Table 5.

Furthermore, the test method used for analyzing the polymers 1 to 14 used in the present test is shown below.

- weight-average molecular weight: measured with tetrahydrofuran as the eluent using GPC (gel permeation chromatography), and determined in terms of polystyrene.
- exothermic peak temperature (Tp): 10 mg of the copolymer is sampled in the differential scanning calorimeter, is heated, under a nitrogen atmosphere, from room temperature to 100° C., and is subsequently maintained at 100° C. for 10 minutes. Subsequently, the copolymer is cooled from 100° C. to −80° C. at 10° C./minute, and the value of the exothermic peak temperature is taken.

TABLE 1

| Ester compound | | |
|---|---|---|
| | n value | $R_1$: carbon atoms |
| ester 1 | 1.7 | C19/C21 = 5/5 parts by mass |
| ester 2 | 1.0 | C19/C21 = 7/3 parts by mass |

TABLE 2

| Copolymer | | | | | | |
|---|---|---|---|---|---|---|
| | $R_2$: carbon atoms | $R_3$: carbon atoms | $R_4$: carbon atoms | Molar fraction [(b1)/(b2)/(b3)] | weight-average molecular weight | exothermic peak temperature (Tp) |
| Polymer 1 | C14 | C10 | C12 | 0.6/0.2/0.2 | 21,000 | −22° C. |
| Polymer 2 | C14 | C12 | C14 | 0.7/0.15/0.15 | 29,000 | −18° C. |
| Polymer 3 | C16 | C10 | C12 | 0.5/0.25/0.25 | 24,000 | −31° C. |
| Polymer 4 | C12 | C14 | C16 | 0.6/0.2/0.2 | 31,000 | −22° C. |
| Polymer 5 | C14 | C10 | C12 | 0.8/0.1/0.1 | 10,000 | −28° C. |
| Polymer 6 | C14 | C10 | C12 | 0.4/0.3/0.3 | 45,000 | −36° C. |
| Polymer 7 | C8 | C14 | C14 | 0.4/0.3/0.3 | 35,000 | −50° C. |
| Polymer 8 | C22 | C12 | C12 | 0.5/0.25/0.25 | 23,000 | +20° C. |
| Polymer 9 | C12 | C18 | C12 | 0.6/0.2/0.2 | 26,000 | −20° C. |
| Polymer 10 | C14 | C12 | C8 | 0.6/0.2/0.2 | 45,000 | −35° C. |
| Polymer 11 | C14 | C12 | C18 | 0.5/0.25/0.25 | 19,000 | −20° C. |
| Polymer 12 | C14 | C12 | C12 | 0.2/0.4/0.4 | 33,000 | −43° C. |
| Polymer 13 | C16 | C12 | C12 | 0.7/0.15/0.15 | 15,000 | −5° C. |
| Polymer 14 | C12 | C12 | C14 | 0.7/0.15/0.15 | 29,000 | −45° C. |

In addition, the measuring method of the test used in the present test for measuring the addition effect caused by the flow improver is shown below.

initial boiling point of distillation, final boiling point of distillation: measured in accordance with JIS K 2254.

Δ(90-20): the distillation characteristics of the fuel oil were measured in accordance with JIS K 2254, and the difference between the distilling temperature at 90 volume % and the distilling temperature at 20 volume % was obtained.

cloud point: measured in accordance with JIS K 2269.

pour point: measured in accordance with JIS K 2269 (per 1° C. of the measured temperature).

plugging point: measured in accordance with JIS K 2288.

sulfur content: measured in accordance with JIS K 2541.

dispersibility of precipitated wax: the fuel oil was put into a 100 mL measuring cylinder, cooled to −10° C., at a speed of 1° C./hour, from room temperature in a cryostat, and was left to stand for 5 hours while being maintained at −10° C. The dispersibility of the precipitated wax at this time was evaluated according to the following criteria.

○ (Good): the wax dispersion layer is 80% or more.

Δ (Acceptable): the wax dispersion layer is 60% or more, and less than 80%.

x (Poor): the wax dispersion layer is 30% or more, and less than 60%.

TABLE 3

| Fuel oils used | | |
|---|---|---|
| | Fuel oil I | Fuel oil II |
| initial boiling point of distillation (° C.) | 157 | 144 |

TABLE 3-continued

| Fuel oils used | | |
|---|---|---|
| | Fuel oil I | Fuel oil II |
| final boiling point of distillation (° C.) | 348 | 360 |
| cloud point (° C.) | −5 | −4 |
| Clogging point (° C.) | −5 | −3 |
| pour point (° C.) | −8 | −7 |
| sulfur content (ppm) | 6 | 7 |
| Δ (90-20) | 92 | 111 |

TABLE 4

| Performance evaluation of flow improver | | | | | | | |
|---|---|---|---|---|---|---|---|
| | Fuel oil | (A) ester compound | (B) polymer | (A)/(B) mass ratio | plugging point (° C.) | pour point (° C.) | dispersibility of precipitated wax |
| Ex. 1 | I | ester 1 | Polymer 1 | 6/4 | −13 | −16 | ○ |
| Ex. 2 | I | ester 2 | Polymer 2 | 5/5 | −12 | −15 | ○ |
| Ex. 3 | I | ester 1 | Polymer 3 | 5/5 | −11 | −15 | ○ |
| Ex. 4 | I | ester 2 | Polymer 4 | 4/6 | −11 | −13 | ○ |
| Ex. 5 | I | ester 1 | Polymer 5 | 4/6 | −11 | −12 | ○ |
| Ex. 6 | I | ester 2 | Polymer 6 | 3/7 | −11 | −13 | ○ |
| Comp. Ex. 1 | I | ester 1 | Polymer 7 | 5/5 | −8 | −9 | Δ |
| Comp. Ex. 2 | I | ester 2 | Polymer 8 | 6/4 | −7 | −9 | x |
| Comp. Ex. 3 | I | ester 1 | Polymer 9 | 4/6 | −9 | −9 | Δ |
| Comp. Ex. 4 | I | ester 2 | Polymer 10 | 5/5 | −10 | −9 | Δ |

TABLE 4-continued

| Performance evaluation of flow improver | | | | | | | |
|---|---|---|---|---|---|---|---|
| | Fuel oil | (A) ester compound | (B) polymer | (A)/(B) mass ratio | plugging point (° C.) | pour point (° C.) | dispersibility of precipitated wax |
| Comp. Ex. 5 | I | ester 1 | Polymer 11 | 5/5 | −8 | −10 | Δ |
| Comp. Ex. 6 | I | ester 2 | Polymer 12 | 7/3 | −6 | −11 | ○ |
| Comp. Ex. 7 | I | ester 1 | Polymer 13 | 3/7 | −7 | −9 | ○ |
| Comp. Ex. 8 | I | ester 2 | Polymer 14 | 5/5 | −9 | −8 | x |

TABLE 5

| Performance evaluation of flow improver | | | | | | | |
|---|---|---|---|---|---|---|---|
| | Fuel oil | (A) ester compound | (B) polymer | (A)/(B) mass ratio | plugging point (° C.) | pour point (° C.) | dispersibility of precipitated wax |
| Ex. 7 | II | ester 1 | Polymer 1 | 5/5 | −13 | −19 | ○ |
| Ex. 8 | II | ester 2 | Polymer 2 | 6/4 | −13 | −17 | ○ |
| Ex. 9 | II | ester 1 | Polymer 3 | 5/5 | −12 | −17 | ○ |
| Ex. 10 | II | ester 2 | Polymer 4 | 4/6 | −10 | −14 | ○ |
| Ex. 11 | II | ester 1 | Polymer 5 | 4/6 | −10 | −14 | ○ |
| Ex. 12 | II | ester 2 | Polymer 6 | 3/7 | −11 | −15 | ○ |
| Comp. Ex. 9 | II | ester 1 | Polymer 7 | 5/5 | −8 | −7 | Δ |
| Comp. Ex. 10 | II | ester 2 | Polymer 8 | 6/4 | −8 | −7 | Δ |
| Comp. Ex. 11 | II | ester 1 | Polymer 9 | 4/6 | −7 | −8 | x |
| Comp. Ex. 12 | II | ester 2 | Polymer 10 | 5/5 | −9 | −11 | x |
| Comp. Ex. 13 | II | ester 1 | Polymer 11 | 5/5 | −8 | −10 | ○ |
| Comp. Ex. 14 | II | ester 2 | Polymer 12 | 7/3 | −10 | −11 | Δ |
| Comp. Ex. 15 | II | ester 1 | Polymer 13 | 3/7 | −5 | −10 | Δ |
| Comp. Ex. 16 | II | ester 2 | Polymer 14 | 5/5 | −11 | −11 | Δ |

From the evaluation results, it may be understood that the flow improver of the present invention can impart an excellent dispersibility of precipitated wax to the fuel oil, in addition to an excellent improvement effect of the plugging point and an excellent improvement effect of the pour point.

INDUSTRIAL APPLICABILITY

The flow improver of the present invention can sufficiently reduce the plugging point and the pour point, and can further increase the wax dispersibility even if used in a vehicle with a high pressure fuel injection pump and a fine fuel filter provided in the fuel supply line. Therefore, the flow improver can be favorably used without easily causing problems, even in a diesel vehicle which conforms to environmental regulations.

What is claimed is:

1. A fuel oil flow improver comprising the ester compound (A) below and the copolymer (B) below, which is the fuel oil flow improver in which the mass ratio [(A)/(B)] of the ester compound (A) and the copolymer (B) is from 30/70 to 70/30;

(A) The ester compound represented by Formula (I) below:

[Chem. 1]

(I)

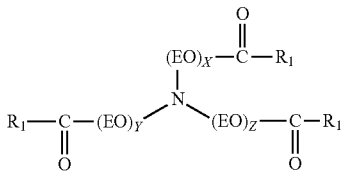

$R_1$ is a linear saturated alkyl group containing 17 to 23 carbon atoms, (EO) represents an oxyethylene group, and X, Y, and Z each represent an integer of 1 or higher; In addition, the average number of additional moles (n) of the oxyethylene group is n=(X+Y+Z)/3, and satisfies $1 \leq n \leq 3$;

(B) A copolymer of a weight-average molecular weight of 5,000 to 50,000 obtained by polymerizing (b1) to (b3) below at a molar fraction of (b1)/(b2)/(b3)=0.4 to 0.8/0.1 to 0.3/0.1 to 0.3, which is the copolymer in which, when the copolymer is measured using a differential scanning calorimeter and cooled from 100° C. to −80° C. at 10° C./minute, the exothermic peak temperature (Tp) is $-40° C. \leq Tp \leq -15° C.$;

[Chem. 2]

(b1)

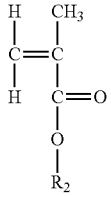

$R_2$ represents a linear saturated alkyl group containing 10 to 18 carbon atoms;

[Chem. 3]

(b2)

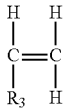

$R_3$ represents a linear saturated alkyl group containing 8 to 16 carbon atoms;

[Chem. 4]

(b3)

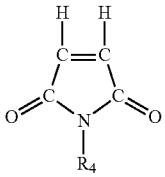

$R_4$ represents a linear saturated alkyl group containing 10 to 16 carbon atoms.

2. A fuel oil composition containing: the fuel oil flow improver according to claim 1, and fuel oil, wherein the fuel oil composition contains 0.0005 to 1 parts by mass of the fuel oil flow improver in relation to 100 parts by mass of the fuel oil.

* * * * *